US005815875A

United States Patent [19]

Yamada

[11] Patent Number: 5,815,875

[45] Date of Patent: Oct. 6, 1998

[54] BI-POSITIONABLE TOOTHBRUSH

[76] Inventor: Todd H. Yamada, 13900 Tahiti Way, #127, Marina Del Rey, Calif. 90292

[21] Appl. No.: 837,548

[22] Filed: Apr. 21, 1997

[51] Int. Cl.[6] ..... A46B 9/04

[52] U.S. Cl. ..... 15/167.1; 15/144.1; 15/145; 403/160

[58] Field of Search ..... 15/144.1, 145, 15/167.1, 172, 176.1; 403/123, 160

[56] References Cited

U.S. PATENT DOCUMENTS

| | | | |
|---|---|---|---|
| 1,473,357 | 11/1923 | Pletman | 15/167.1 |
| 2,542,038 | 2/1951 | Lewis | 403/160 |
| 2,742,936 | 4/1956 | Cooley | 403/160 |
| 2,750,616 | 6/1956 | Klugmann | 15/144.1 |
| 5,033,154 | 7/1991 | Marchland et al. | 15/145 |
| 5,673,453 | 10/1997 | Huang | 15/167.1 |

*Primary Examiner*—Terrence Till
*Attorney, Agent, or Firm*—Beehler & Pavitt

[57] ABSTRACT

A bi-positional toothbrush comprising a brush head member rotatably mounted to a handle by a cylindrical pin. The brush head member includes an array of bristles at a forward end and terminates in an essentially flat angled surface at a rearward end. The angled surface includes an axial bore orthogonal thereto, sized to receive the pin and terminating in a means to rotatably and removably secure the pin within the axial bore. The handle is elongated and includes at a forward end an essentially flat surface angled at the same angle to the long axis of the handle as the angled flat surface of the brush head member is to its long axis. The angled flat surface of the handle includes an axial bore, including securing features, shaped to constrain an after end of the pin. The angled surfaces of the handle and brush head member include symmetrical locking features. The angle between the handle and the brush head member may be changed from 180 degrees (no offset) to offset by pulling the handle rearward from the brush member to disengage the symmetrical locking features of the angled surfaces, twisting the handle approximately 180 degrees with respect to the brush head member, and pushing the handle into the brush head member to reengage the symmetrical locking features and to allow the head of the pin to engage the securing means within the axial bore. Likewise, the offset may be reversed by repeating the same procedure.

8 Claims, 3 Drawing Sheets

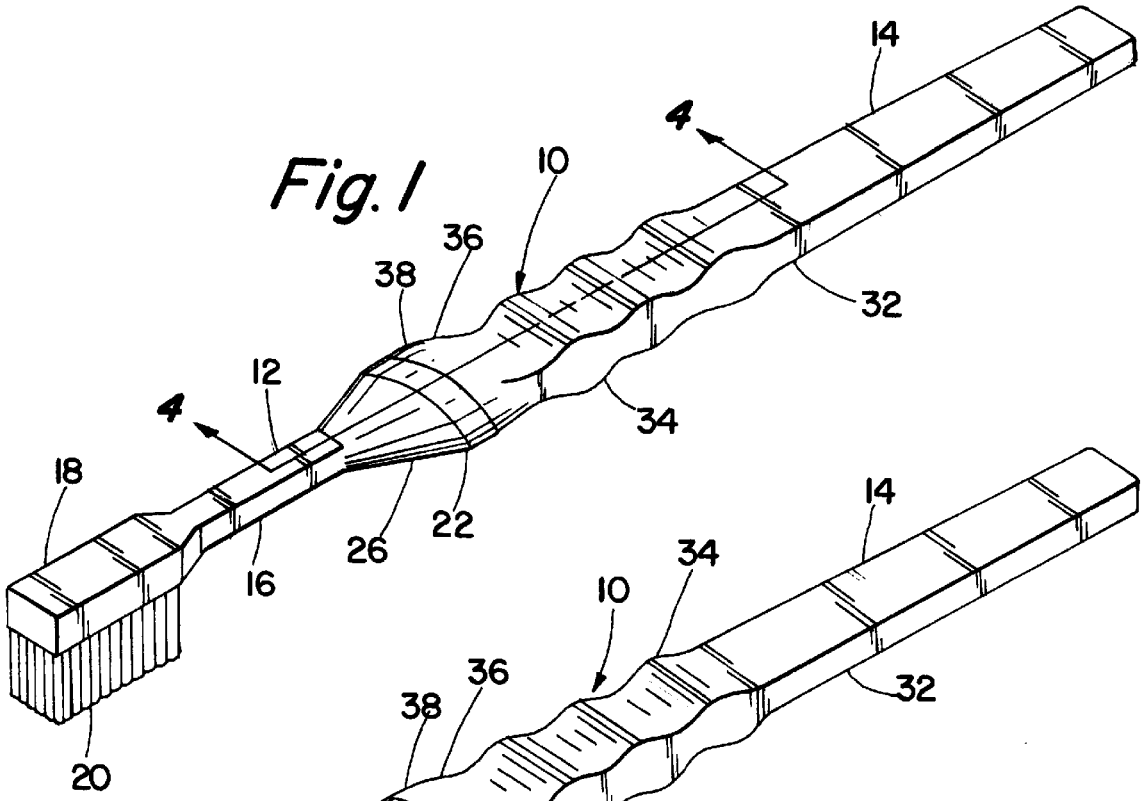
Fig. 1
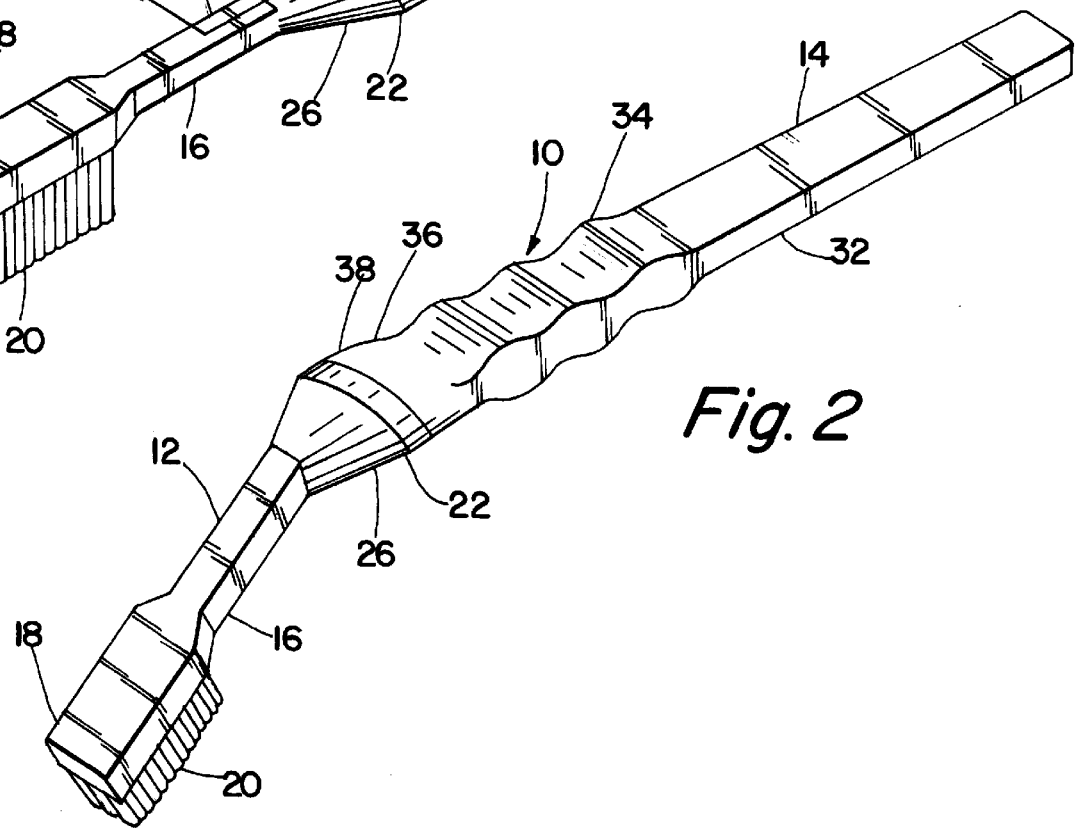
Fig. 2
Fig. 3
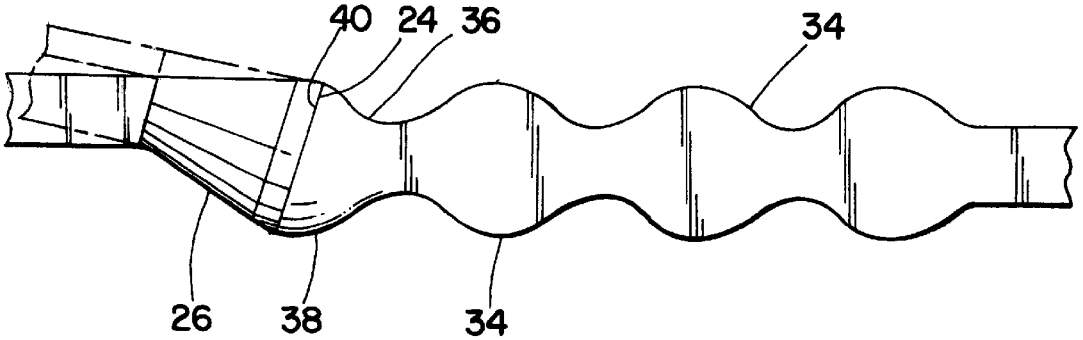

BI-POSITIONABLE TOOTHBRUSH

FIELD OF THE INVENTION

This invention relates to the field of multi-positionable brushes in general, and, in particular, to bi-positionable toothbrushes.

BACKGROUND OF THE INVENTION

Description of the Prior Art

The desirability for certain uses of a toothbrush, the bristle array of which can be moved angularly with respect to the handle has been recognized for more than a 100 years, as evidenced by U.S. Pat. No. 430,909. Since then, there have been issued numerous United States and foreign patents on toothbrushes designed with such capability. Examples are British Patent No. 191,745, issued in 1923; Austrian Patent No. 134,759, issued in 1933; French Patent No. 1,075,819, issued in 1954; German Patent No. 214,298, issued in 1960; French Patent No. 2,450,579, issued in 1979; and U.S. Pat. Nos. 4,731,896, 5,033,154, 5,003,658, 5,228,166 and No. 5,442,831, issued Aug. 22, 1995, to the present inventor.

The problem with the prior art devices is that they have not met all of the desired features for an angularly adjustable toothbrush. Principal among these features are: effectiveness in holding the angular position in which the toothbrush may be set; simplicity of construction and assembly and related requirement of minimizing the expense of its manufacture; convenience for the user, both from the standpoint of adjusting the angle and from the standpoint of holding the brush during the toothbrushing operation. Prior art brushes have failed adequately to meet one or more of these desirable features.

SUMMARY OF THE INVENTION

In a first embodiment of the invention an angularly adjustable toothbrush may be constructed of two moldable parts and a pin.

The two parts are the rotatable brush head member and the handle. The brush head member is elongated and rigid having a predetermined length, with a forward end and an after end, the forward end supports a brush array extending laterally, and the after end of said member being flared and terminating in an essentially flat first surface angled with respect to a long axis of the member. This first angled surface includes a series of symmetrical locking features. The brush head member has a first axial bore commencing at the first angled surface and is orthogonal thereto and terminates inwardly. The axial bore including a means of removably and rotatably securing a pin therein.

The handle has a predetermined length, with a forward end and an after end, the forward end of the handle being flared and terminating in an essentially flat second angled surface angled with respect to a long axis of the handle. The second angled surface includes a series of mating symmetrical locking features configured to mate with the symmetrical locking features of the first angled surface of the brush head member. The handle has a second axial bore, which includes securing features, commencing at the second angled surface and orthogonal thereto and terminating inwardly.

The pin is of cylindrical cross-section and has a forward end and an after end and includes at the forward end, a means of being removably and rotatably secured within the first axial bore of the brush head member. The pin includes at the after end, a means of being permanently secured within the second axial bore of the handle.

It is preferred that the handle of the angularly adjustable toothbrush include a series of finger gripping features. It is also preferred that the symmetrical locking features on the angled surface of brush head member and the angled surface of the handle are a series of parallel grooves. In an alternative configuration it is preferred that the symmetrical locking features on the angled surface of brush head member and the angled surface of the handle are a series of mating pins and holes.

In a second embodiment, the present invention may be constructed of two moldable parts and a bifurcated pin.

These two parts are the rotatable brush head member and the handle. The brush head member is elongated and rigid, with its forward end carrying bristles extending transversely outwardly from one side of the forward end. The after end of the brush head member terminates in an essentially flat surface angled at less than 90 degrees to the long axis of the member. The after end of the brush head member contains an axial bore orthogonal to the angled flat surface. The axial bore extends partially into the member and terminates in a transverse passage. The axial bore is counterbored to approximately twice the diameter of the axial bore for approximately the first one forth of its depth from the angled flat surface. The angled flat surface of the brush head member includes a series of symmetrical locking features such as parallel grooves, holes or projecting pins.

The handle is elongated and rigid and its forward end may include a series of finger grip features. The forward end of the handle terminates in an essentially flat surface angled to the long axis of the handle at an angle complementary to the included angle between the angled surface of the brush head member and the long axis of the member, that is, such that the sum of the two angles is 180 degrees. The angled flat surface of the handle contains a series of symmetrical locking features such as parallel grooves shaped to mate with the matching symmetrical locking features on the angled flat surface of the brush head member. The forward end of the handle includes an axial bore, containing threads or some other securing feature, othoganal to the angled flat surface.

The bifurcated pin is formed of a resilient material and is cylindrical in cross-section. The forward end of the bifurcated pin includes a split head which is of larger diameter than the axial bore in the brush head member but able to be compressed to the diameter of the axial bore due to the split in the head. The split head expands to its full diameter when it passes into the transverse passage which terminates the axial bore in the brush head member. The two halves of the split head are attached to the split portion of the shaft of the bifurcated pin extending backwardly from the head. The diameter of the shaft is sized to slide easily within the axial bore of the brush head member. The shaft of the bifurcated pin includes a non-split portion extending rearward from the split portion to provide additional strength to the shaft. Extending rearward from the non-split portion of the shaft the bifurcated pin includes a portion of increased diameter shaped to fit the counter-bored portion of the axial bore in the brush head member. The increased diameter portion also serves to add strength to the bifurcated pin. Extending rearwardly from the increased diameter portion of the bifurcated pin is a portion of reduced diameter, including threads or other securing features, shaped to fit the mating securing features of the axial bore in the handle.

Selection of the angle of the brush head member with respect to the handle is effected by pulling the handle away from the brush head member sufficiently to retract the split head of the bifurcated pin from the transverse passage in the brush head member and into the smaller diameter of the axial bore. When the bifurcated pin is so retracted the mating symmetrical locking features on the angled flat surfaces of the brush head member and the handle will be disengaged and the handle may be twisted with respect to the brush head member.

When the handle is twisted to a first position and the handle pushed into the brush head member so that the symmetrical locking features align, the resulting toothbrush will have an essentially straight handle. When the handle again pulled partially away from the brush head member and twisted approximately 180 degrees to a second position and the handle pushed into the brush head member so that the mating locking features align, the resulting tooth brush will have a handle which is offset from the brush head member by the difference between 180 degrees and the sum of the included angle between the long axis of the brush head member and its angled surface and the included angle between the long axis of the handle and its angled surface. For example, if the angled surfaces of the brush head member an the handle are each angled at 75 degrees to their long axes, the sum of their included angles would be 150 degrees. The difference between this sum and 180 degrees is 30 degrees, the resulting offset of the handle from the brush head member.

When the handle is pushed fully into the brush head member so that the split head of the bifurcated pin can expand within the transverse passage in the brush head member, the mating locking features on the angled surfaces of the brush head member and the handle will be held tightly together by the tendency of the split head to remain in its fully expanded position within the transverse passage.

It may thus be seen that the present invention provides an easily adjustable angled toothbrush of a simple design which may be fabricated of two molded parts and a bifurcated pin, all of which are easily assembled.

DESCRIPTION OF THE DRAWINGS

In the accompanying drawings:

FIG. 1 is a perspective view of an embodiment of the toothbrush of the present invention in its axially extended position;

FIG. 2 is a perspective view of the toothbrush shown in FIG. 1 in its angled position;

FIG. 3 is a side elevation detail of the adjustable angle feature of the toothbrush shown in FIG. 1;

DESCRIPTION OF THE PREFERRED EMBODIMENT

FIGS. 1 and 2 of the application illustrate a preferred embodiment of the invention with the handle positioned in straight and angled positions with respect to the brush head member. These Figures illustrate that the invention permits a toothbrush of relatively conventional form and appearance.

Figure 4:
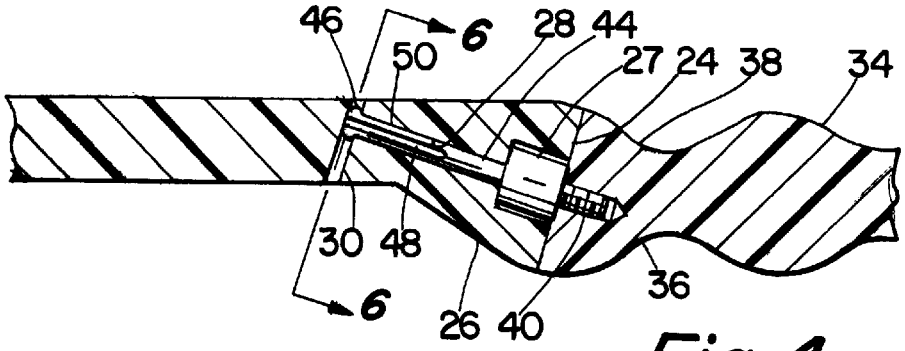
FIG. 4 is a cross-section of FIG. 1 taken along line 4—4 showing the transverse passage, axial bore, and counter bore of the brush head member, the bifurcated pin, and the handle with threaded axial bore.
Figure 5:
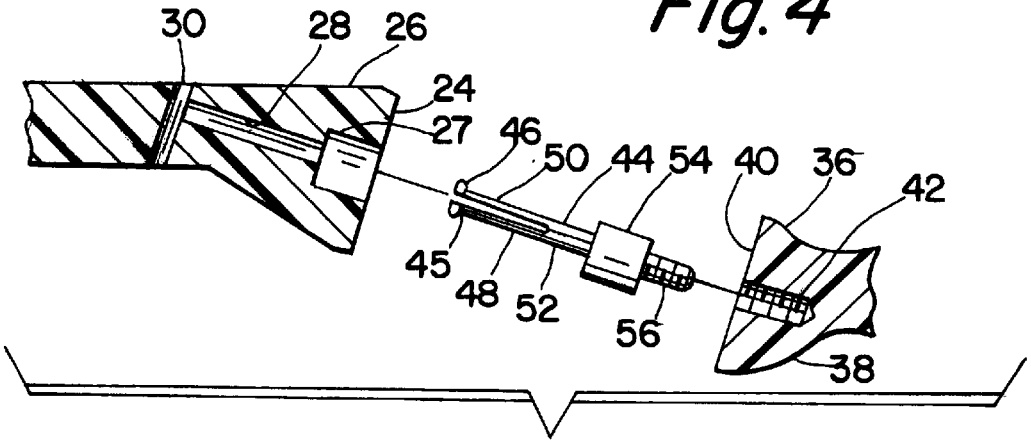
FIG. 5 is an exploded cross-sectional view of FIG. 4.
Figure 6:
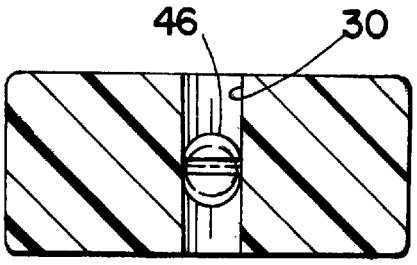
FIG. 6 is a cross-sectional end view detail of the transverse passage and bifurcated pin shown in FIG. 4 taken at line 6—6.
Figure 7:
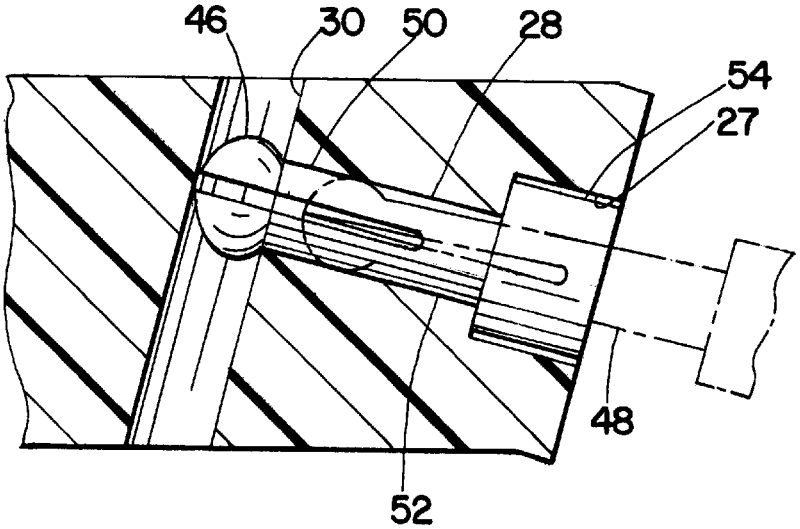
FIG. 7 is a cross-sectional side view detail of the transverse passage, axial bore, counterbore, and bifurcated pin shown in FIG. 4, illustrating full expansion of the split head within the transverse passage and partial retraction of the transverse pin within the axial bore.
Figure 8:
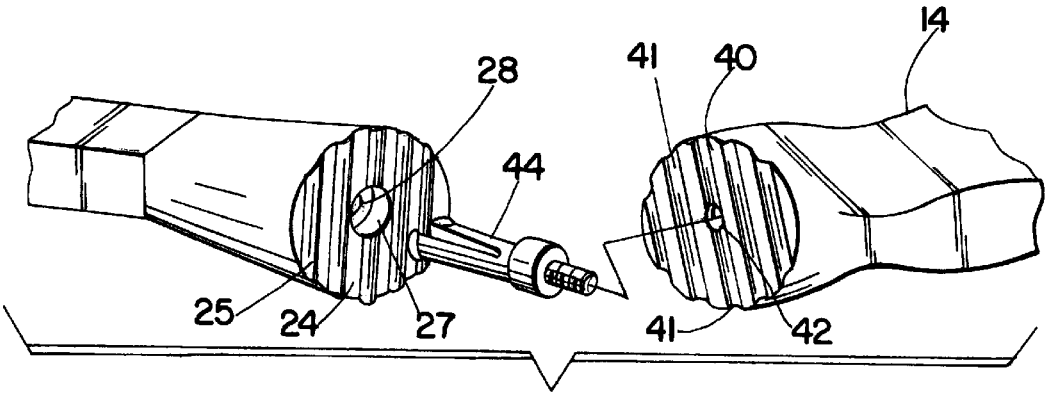
FIG. 8 is an exploded isometric view of FIG. 5 illustrating the parallel groove type symmetrical locking features on the angled surface of the brush head member and the mating symmetrical locking features on the angled surface of the handle.
Figure 9:
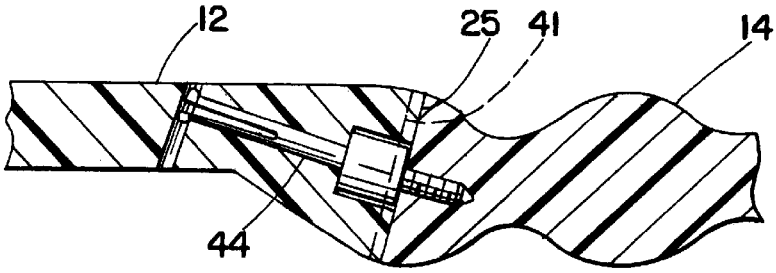
FIG. 9 is a cross-sectional view of FIG. 4 illustrating the parallel groove type symmetrical locking features of the brush head member and the mating symmetrical locking features of the handle.
Figure 10:
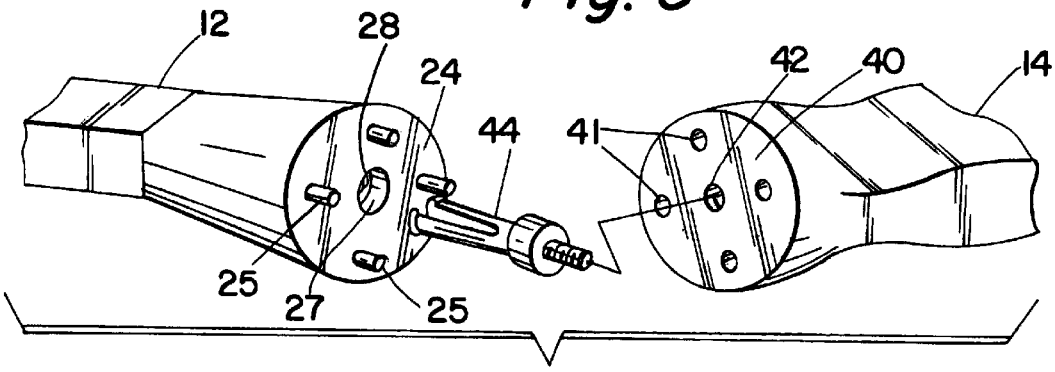
FIG. 10 is an exploded isometric view of FIG. 5 illustrating the pin and hole type symmetrical locking features on the angled surface of the brush head member and the mating symmetrical locking features on the angled surface of the handle.
Figure 11:
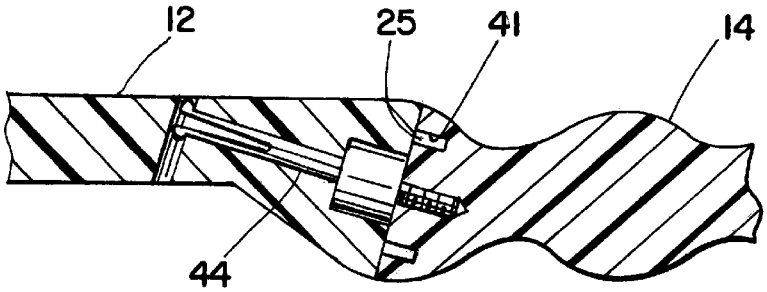
FIG. 11 is a cross-sectional view of FIG. 4 illustrating the pin and groove type symmetrical locking features of the brush head member and the mating symmetrical locking features of the handle.

Referring to FIGS. 1 and 2, a toothbrush 10 is constructed of brush head member 12 and a handle member 14. The brush head member 12 may be molded of plastic as an elongated element 16 having a forward end 18 supporting a brush array 20. The after end 22 of the brush head member terminates in a portion 26 which is flared out as shown in FIGS. 1–5, with an essentially flat angled surface 24 (FIGS. 1–5). Angled surface 24 has an axial bore 28 orthogonal to the angled surface, which terminates in a transverse passage 30 (FIGS. 4–7). The axial bore 28 is counterbored 27 to a larger diameter beginning at angled surface 24 for a portion of its depth (FIGS. 4, 5 and 7). Angled surface 24 includes a series of symmetrical locking features 25 shaped to provide a locking capability when the brush head member is joined to the handle (FIGS. 8 and 9).

The handle member 14 may be molded of plastic as an elongated element 32 (FIGS. 1 and 2), with a series of optional finger gripping features 34 positioned on its upper and lower surfaces adjacent a forward end (FIGS. 1–4). The forward end 36 of the handle terminates in a portion 38 which is flared out as shown in FIGS. 1–5, with an essentially flat angled surface 40 (FIGS. 3–5). Angled surface 40 has an axial bore 42, with threads or other securing features, orthogonal to the angled surface (FIGS. 4 and 5). Angled surface 40 includes a series of symmetrical locking features 41 shaped to provide a locking capability by mating with matching symmetrical locking features 25 on the angled surface of the brush head member when joined to the handle (FIGS. 8 and 9).

A bifurcated pin 44 of cylindrical cross-section is used to join the brush head member to the handle (FIGS. 4–7). The bifurcated pin 44 includes at a forward end 45, a split head 46 of diameter larger than axial bore 28 but able to be compressed to fit within said axial bore due to the split and the resilient nature of the pin material. Extending rearward from the split head, the bifurcated pin includes a shaft 48 which is split 50 for a portion of its length and solid for the remainder to add strength to the pin (FIGS. 4, 5 and 7). Extending rearward from the non-split portion of the shaft 52 (FIGS. 5 and 7) the bifurcated pin includes a portion of increased diameter 54 shaped to fit the counter-bored portion of the axial bore 27 in the brush head member 12. The increased diameter portion 54 also serves to add strength to the bifurcated pin 44. Extending rearwardly from the increased diameter portion 54 of the bifurcated pin is a portion 56 (FIG. 5) of reduced diameter, having threads or other securing features, shaped to fit the mating threaded axial bore 42 in the handle 14.

The angle of the brush head member 12 with respect to the handle 14 may be selected by pulling the handle 14 away from the brush head member 12 sufficiently to retract the split head 46 of the bifurcated pin 44 from the transverse passage 46 in the brush head member 12 and into the smaller diameter of the axial bore 28. When the bifurcated pin 44 is retracted into the axial bore 28, the symmetrical locking features 25 on the angled flat surface 24 of the brush head member 12 and mating symmetrical locking features 41 on the angled flat surface 40 of the handle 14 will be disengaged and the handle 14 may be twisted with respect to the brush head member 12. When the handle 14 is twisted to a first position and the handle 14 pushed into the brush head member 12 so that the symmetrical locking features 25 and mating symmetrical locking features 41 align, the resulting toothbrush 10 will have an essentially straight handle (FIG. 1). When the handle 14 is twisted approximately 180 degrees to a second position and the handle 14 is pushed into the brush head member 12 so that the symmetrical locking features 25 and mating symmetrical locking features 41 align, the resulting tooth brush 10 will have a handle 14 which is offset from the brush head member 12 by the difference between 180 degrees and the sum of the included angle between the long axis of the brush head member 12 and its angled surface 24 and the included angle between the long axis of the handle 14 and its angled surface 40. (FIG. 2). When the handle 14 is pushed fully into the brush head member 12 so that the split head 46 of the bifurcated pin 44 can expand within the transverse passage 30 in the brush head member 12, the symmetrical locking features 25 and mating symmetrical locking features 41 on the angled surfaces 24 of the brush head member 12 and angled surface 40 of the handle 14 will be held tightly together by the tendency of the split head 46 to remain in its fully expanded position within the transverse passage 30 (FIG. 7).

The preferred configuration of the toothbrush 10 is shown in FIGS. 1 and 2 where it may be seen that the cross-section of the brush head member 12 and handle 14 is roughly rectangular and the handle 14 includes a series of finger gripping features 34. However, the invention should be deemed to comprehend any other cross-sectional shape for the brush head member 12 and handle 14 which would support similar internal construction as disclosed in FIGS. 4–9. Likewise, the finger gripping features 34 should be considered as optional.

It may be seen from the foregoing description, that an adjustable angle toothbrush may be provided by the present invention which may be manufactured and assembled easily by the use of molded parts, and when assembled, may be simply operated to allow two angular adjustments with respect to the axis of the handle.

I claim:

1. An angularly adjustable toothbrush comprising:

an elongated brush head member, said member having a predetermined length, with a forward end and an after end, the forward end supporting a brush array extending laterally, and the after end of said member being flared and terminating in an essentially flat first surface angled with respect to a long axis of said member;

said first angled surface including a series of symmetrical locking features;

said member having a first axial bore commencing at said first angled surface and orthogonal thereto and terminating inwardly;

said axial bore including a means of removably and rotatably securing a pin therein;

a handle having a predetermined length, with a forward end and an after end, the forward end of said handle being flared and terminating in an essentially flat second angled surface angled with respect to a long axis of said handle;

said second angled surface including a series of mating symmetrical locking features configured to mate with said symmetrical locking features of said first angled surface of said brush head member;

said handle having a second axial bore, including securing features, commencing at said second angled surface and orthogonal thereto and terminating inwardly;

a pin of cylindrical cross-section having a forward end and an after end;

said pin including at a forward end, a means of being removably and rotatably secured within said first axial bore; and said pin including at an after end, a means of being permanently secured within said second axial bore.

2. The angularly adjustable toothbrush as described in claim 1 wherein the handle includes a series of finger gripping features.

3. The angularly adjustable toothbrush as described in claim 1 or claim 2 wherein the symmetrical locking features on the angled surface of brush head member and the angled surface of the handle are a series of parallel grooves.

4. The angularly adjustable toothbrush as described in claim 1 or claim 2 wherein the symmetrical locking features on the angled surface of brush head member and the angled surface of the handle are a series of mating pins and holes.

5. An angularly adjustable toothbrush comprising:

an elongated brush head member, said member having a predetermined length, with a forward end and an after end, the forward end supporting a brush array extending laterally, and the after end of said member being flared and terminating in an essentially flat first surface angled with respect to a long axis of said member;

said member having a first axial bore commencing at said first angled surface and orthogonal thereto and terminating inwardly in a transverse passageway;

said first axial bore being counter bored to a larger diameter for a portion of its length commencing at said first angled surface;

said first angled surface including a series of symmetrical locking features;

a handle having a predetermined length, with a forward end and an after end, the forward end of said handle being flared and terminating in an essentially flat second angled surface angled with respect to a long axis of said handle;

said handle having a second axial bore, including securing features, commencing at said second angled surface and orthogonal thereto and terminating inwardly;

said second angled surface including a series of mating symmetrical locking features configured to mate with said symmetrical locking features of said first angled surface of said brush head member;

a bifurcated pin of cylindrical cross-section formed of a resilient material having a forward end and an after end;

said forward end including a split head of diameter larger than said axial bore;

said split head being capable of being compressed to fit within said first axial bore;

said bifurcated pin including a shaft having a split portion commencing at said split head and extending rearwardly therefrom and connecting to a non-split portion of said shaft;

said shaft sized to slide within said first axial bore;

said non-split portion of said shaft extending rearwardly and connecting to a shaft portion of increased diameter;

said increased diameter portion of said shaft sized to fit within said counterbored portion of said first axial bore;

said increased diameter portion of said shaft extending rearwardly and connecting to a shaft portion of reduced diameter, including securing features, shaped to match said second axial bore in said handle;

said reduced diameter shaft portion of said bifurcated pin being attached by said securing features to said second axial bore in said handle;

said brush head member being secured to said handle in a first alternative angular position by inserting said split head of said bifurcated pin into said first axial bore of said brush head member and twisting said handle with respect to said brush head member to align said symmetrical locking features on said brush head member with said mating symmetrical locking features on said handle and then further inserting said bifurcated pin into said first axial bore to allow said split head of said pin to expand to its full diameter within said transverse passage;

said brush head member being secured to said handle in a second alternative angular position by pulling said handle away from said brush head member sufficiently to withdraw said split head of said bifurcated pin into said axial bore thus disengaging said symmetrical locking features of said member and said mating symmetrical locking features of said handle and twisting said handle approximately 180 degrees with respect to said member and then pushing said brush head member and said handle together thus engaging said symmetrical locking features with said mating symmetrical locking features and thus securing said brush head member to said handle in said second angular position.

6. The angularly adjustable toothbrush as described in claim 5 wherein the handle includes a series of finger gripping features.

7. The angularly adjustable toothbrush as described in claim 5 or claim 6 wherein the symmetrical locking features on the angled surface of brush head member and the angled surface of the handle are a series of parallel grooves.

8. The angularly adjustable toothbrush as described in claim 5 or claim 6 wherein the symmetrical locking features on the angled surface of brush head member and the angled surface of the handle are a series of mating pins and holes.

* * * * *